US006942092B1

(12) United States Patent
Laarman

(10) Patent No.: US 6,942,092 B1
(45) Date of Patent: Sep. 13, 2005

(54) SLEEVE FOR DIGITAL MEDIA DISK

(75) Inventor: Lisa Laarman, Seattle, WA (US)

(73) Assignee: Starbucks Corporation, Seattle, WA (US)

( * ) Notice: Subject to any disclaimer, the term of this patent is extended or adjusted under 35 U.S.C. 154(b) by 0 days.

(21) Appl. No.: 10/800,811

(22) Filed: Mar. 15, 2004

(51) Int. Cl.[7] ..... B65D 85/57
(52) U.S. Cl. ..... 206/232; 206/308.1; 206/312
(58) Field of Search ..... 206/232, 308.1, 206/309–313; 281/31, 38, 45, 49; 402/3, 402/71

(56) References Cited

U.S. PATENT DOCUMENTS 4,314,635 A * 2/1982 Fraser et al. ..... 206/232
5,207,717 A * 5/1993 Manning ..... 206/232
5,215,398 A * 6/1993 White et al. ..... 281/31
5,655,656 A 8/1997 Gottlieb
5,697,496 A 12/1997 Bauer
5,947,281 A * 9/1999 Kaneff ..... 206/312
6,016,907 A * 1/2000 Dreier ..... 206/232
6,068,116 A * 5/2000 Bankhead ..... 206/312
6,202,839 B1 * 3/2001 Petersen et al. ..... 206/308.1
6,241,085 B1 6/2001 Koehn
6,612,433 B2 9/2003 McKenzie
6,637,588 B1 10/2003 Stamer

* cited by examiner

*Primary Examiner*—Luan K. Bui
(74) *Attorney, Agent, or Firm*—Christensen O'Connor Johnson Kindness PLLC

(57) ABSTRACT

A sleeve assembly (100) for a digital media disk (90) or similar flat product, made from paperboard. The sleeve assembly includes a sleeve member (110) having a plurality of hingedly connected panels (116, 126, 136), wherein one or more of the panels includes apertures (112, 114). Two of the panels include retaining members (121, 131) and a third panel includes a pocket (141) adapted to receive the disk. A removable placard (160), having identifying indicia (162, 164) that is at least partially visible through the apertures, and is removably retained by the retaining members. In a preferred embodiment, an aperture is included on one of the hinge spines, such that a portion of the placard can be seen from the end of a folded sleeve assembly. The sleeve member may be generic, while the placard identifies the received disk.

20 Claims, 6 Drawing Sheets

SLEEVE FOR DIGITAL MEDIA DISK

FIELD OF THE INVENTION

The invention relates generally to packaging systems and, in particular, to packaging for flat products such as compact disks and digital video disks.

BACKGROUND OF THE INVENTION

Digital information/entertainment products are increasingly being distributed on flat storage media, such as compact disks ("CDs"), digital video disks ("DVDs"), and the like. For example, music, music videos, movies, software, photographs, promotional materials such as catalogues, and directories are commonly produced and distributed on CDs and/or DVDs. CDs, DVDs, and similar flat storage media are collectively referred to herein as "digital media disks." Digital media disks have many advantages over other prior art storage media. They are relatively easy and inexpensive to produce, flexible to modify and format, and provide a convenient form factor. Although the most common digital media disks are circular with a diameter of about 12 cm, digital media disks having different sizes and/or shapes are also available. Digital media disks are generally amenable to external markings—for example, to identify the digital content stored on the media, and/or to provide other aesthetic, promotional, and/or informational content. Players for the various types of digital media disks are becoming ubiquitous.

The packaging of music CDs, for example, frequently includes a hard, transparent or semi-transparent, plastic case, often called a "jewel case." An insert or placard is frequently insertable into the jewel case, providing identifying indicia indicating the content of the CD. The insert may include other information, such as a playlist, lyrics, copyright notice, content warnings or ratings, and credits such as the various artists and producers involved in producing the CD.

The conventional jewel case, however, has some disadvantages. The jewel case is relatively thick and heavy, with many hard corners. This may make the jewel case (and enclosed CD) inconvenient to carry around, such as in a pocket or backpack. The jewel case is also typically formed of a brittle, hard plastic that is susceptible to scratching and breakage. For example, the jewel case may break when dropped or otherwise mishandled, and, in particular, the integral hinge mechanism is susceptible to damage. The jewel case also can be difficult to open. The jewel case also typically includes an engagement member that extends through the center hole in the CD and clasps the CD to secure it to the case and prevent it from accidentally falling out while the jewel case is being opened. Such engagement members, however, may further complicate removal of the CD and, in particular, may result in damage to the CD—for example, if the user attempts to remove the CD by pulling upwardly on an outer edge without first disengaging the mechanism. Such jewel cases are also relatively expensive to produce.

Other cases for CDs have been proposed that overcome some of the jewel case disadvantages discussed above, utilizing paperboard material to form the carrier. For example, U.S. Pat. No. 5,655,656 discloses a two-piece sleeve package for compact disks made from paperboard card stock, having an outer container and a separable inner sleeve that slidably engages the outer container. U.S. Pat. No. 6,241,085 discloses a folded paperboard CD carrier for holding a plurality of CDs in a side-by-side arrangement.

U.S. Pat. No. 6,637,588 discloses a folded paperboard CD carrier having a folded panel including a protrusion that is adapted to be inserted through the center aperture of the CD. However, these carriers are relatively complex. Moreover, because paperboard is opaque, the user cannot readily identify the content of the enclosed CD without opening the carrier.

There remains a need, therefore, for a carrier for digital media disks such as CDs and DVDs that is relatively simple and easy to produce, and easy to open for removing a digital media disk.

SUMMARY OF THE INVENTION

A sleeve assembly for a digital media disk such as a compact disk, digital video disk, or the like, is disclosed. The sleeve assembly allows the use of a generic, sleeve member that does not have product-specific indicia, in combination with a placard that is removably retained therewith, the placard having product-specific indicia. At least a portion of the identifying indicia is visible through one or more apertures in the sleeve assembly, even when the sleeve assembly is in a closed configuration. The sleeve assembly includes a multipanel sleeve member, such as a three-panel, tri-fold type sleeve, wherein a first and second panel each include a retaining member for retaining a placard having identifying indicia printed thereon. One or both of the first and second panels have apertures that are positioned to expose at least a portion of the identifying indicia on the placard. A third panel includes a pocket that opens inwardly, and that is adapted to receive a digital media disk such that the disk is securely retained in the sleeve when the sleeve assembly is folded to a closed position.

In an embodiment of the invention, an aperture is provided that straddles the first and second panels, whereby when the sleeve assembly is closed, the aperture extends across the spine of the fold, to expose a portion of the placard that is viewable from the end of the sleeve assembly. This may allow the user to identify a particular disk from a stack of similar disks.

In an embodiment of the invention, the sleeve member is generic—that is, it does not include any information identifying the digital media disk that is intended to be stored therein, such that identical sleeve members may be used for any of a number of different disks. The indicia that is particular to the intended disk is printed on the placard, which is a planar, relatively easily printed element.

In an embodiment of the invention, the digital media disk is a music CD, and the placard further includes indicia printed thereon identifying the music contained on the music CD.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
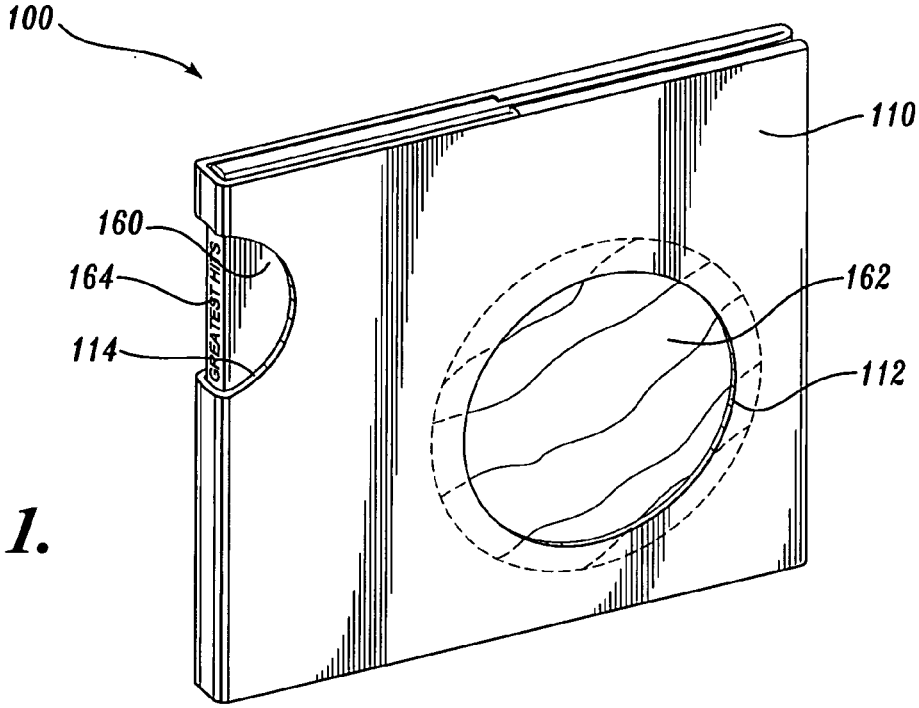
FIG. 1 is a perspective view of an embodiment of a sleeve assembly for a digital media disk, shown in the folded configuration, and made in accordance with the present invention.

A currently preferred embodiment of the present invention will now be described, with reference to the figures, wherein like numbers indicate like parts. FIG. 1 is a perspective view of an assembled digital media disk sleeve assembly 100, shown in a closed, or folded, configuration. The sleeve assembly 100 includes a sleeve member 110 that is preferably die cut from a sheet of paperboard, as discussed in detail below. The sleeve member 110 includes a front aperture 112 and a spine aperture 114. A removable placard 160 (partially visible in FIG. 1) is disposed generally inside the folded sleeve member 110, and includes a portion that is visible through the front aperture 112 and the spine aperture 114 of the sleeve member 110. The placard 160 may include first identifying indicia 162 printed or otherwise disposed on the placard to be visible through the front aperture 112, and second identifying indicia 164 printed or otherwise disposed on the placard 160 to be visible through the spine aperture 114.

Figure 2A:
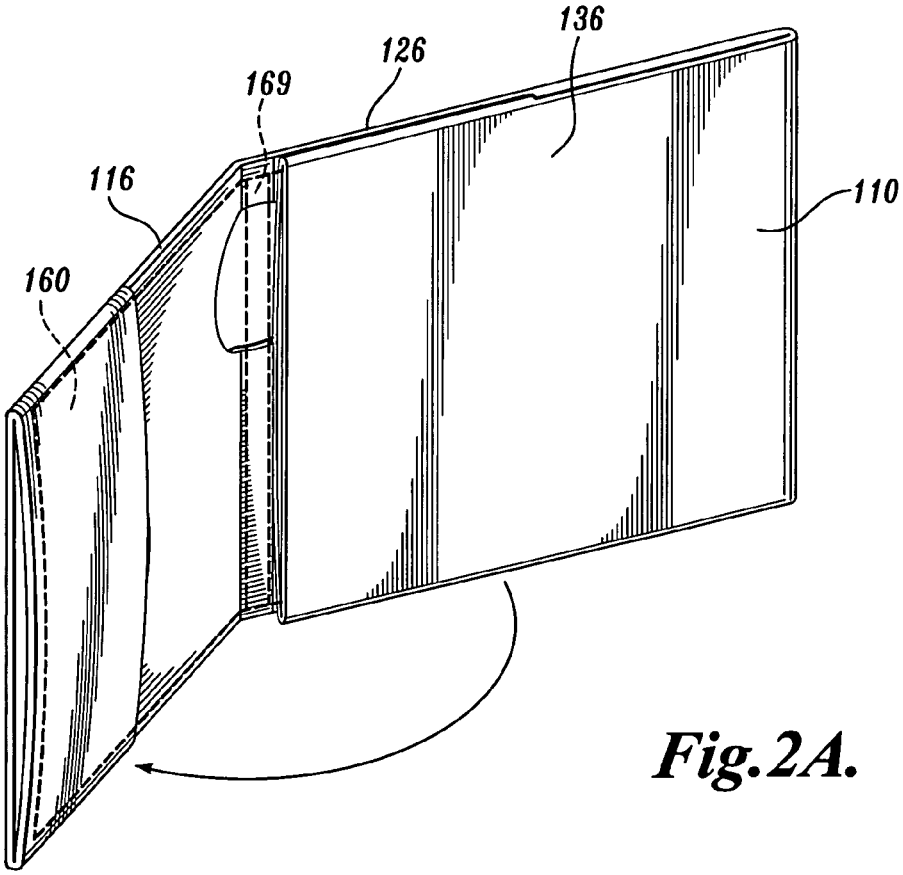
FIGS. 2A and 2B show the sleeve assembly of FIG. 1, partially and then substantially fully open.
Figure 2B:
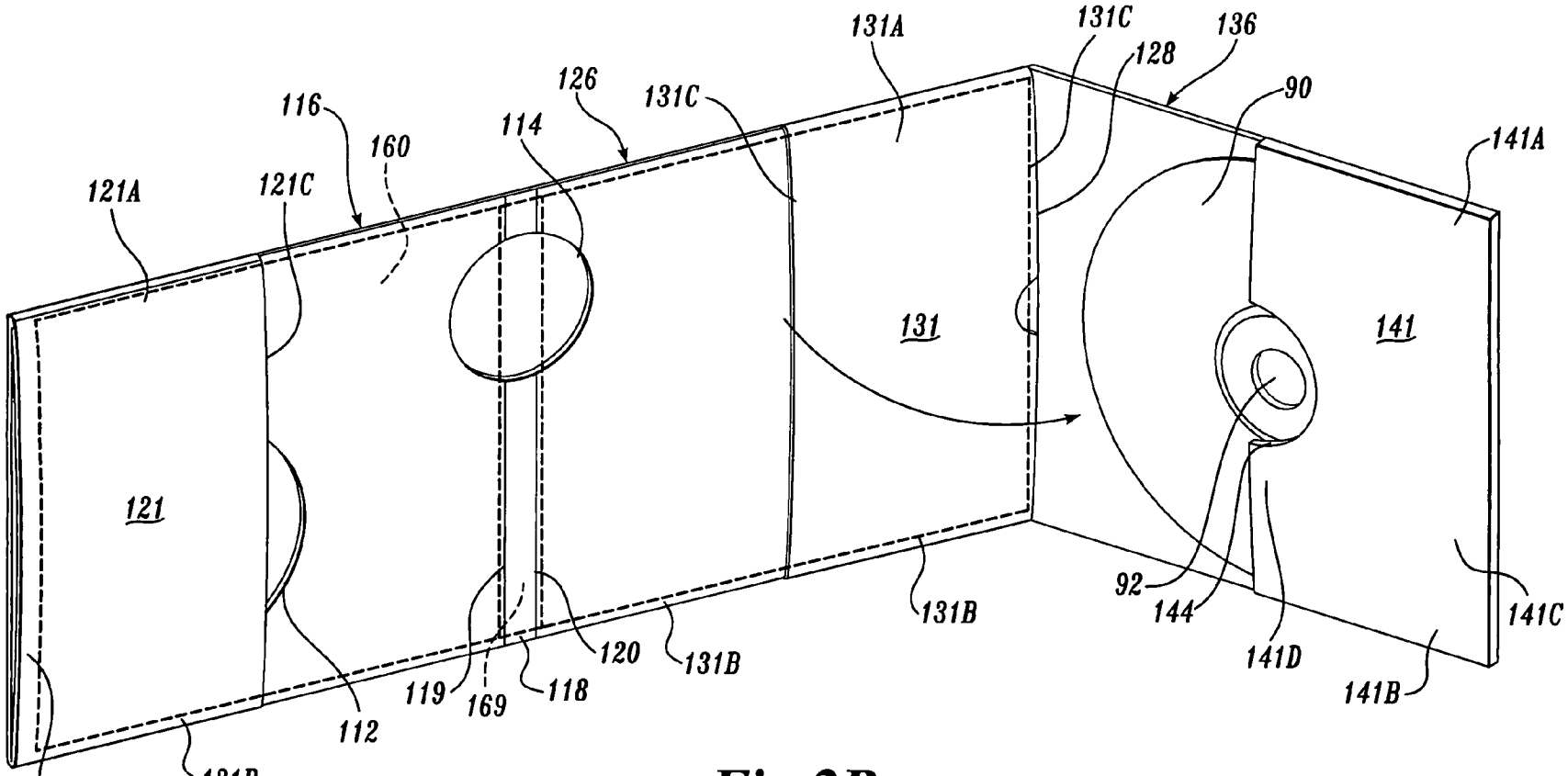

FIG. 2A shows the sleeve assembly 100 partially opened, and FIG. 2B shows the sleeve assembly 100 substantially fully opened, with the placard 160 shown in phantom to expose details of the sleeve member 110, and arrows included to show the unfolding sequence. The sleeve assembly 100 is shown having a three-panel, or "tri-fold," configuration. It is contemplated, however, that the present invention may be readily practiced using a four-panel, or more than four-panel sleeve assembly in a straightforward manner, without departing from the present invention, and may be readily adapted to hold more than one digital media disk.

As seen most clearly in FIG. 2B, the sleeve member 110 includes a first end panel 116, a middle panel 126, and a second end panel 136. The first end panel 116 is hingedly connected to the middle panel 126 through hinge portion 118, which is preferably formed by two closely-spaced, parallel folds 119, 120. A first retaining member 121 overlies and generally conforms to the distal portion of the first end panel 116. The first retaining member 121 is connected to the first end panel 116 at the top edge 121A and bottom edge 121B, and is free or open on the sides 121C, such that a flat channel or opening is formed between the first retaining member 121 and the first end panel 116.

The middle panel 126 is also hingedly connected to the second end panel 136 through hinge portion 128, which is preferably formed by a single transverse fold. The middle panel 126, includes a second retaining member 131, opposite the first retaining member 121, and disposed generally adjacent to the second end panel. The second retaining member 131 is connected to the middle panel 126 at the top edge 131A and bottom edge 131B, and free on the sides 131C, such that a flat channel or opening is formed between the second retaining member 131 and the middle panel 126.

The second end panel 136 includes a pocket member 141 disposed at the distal end of the second end panel 136. The pocket member 141 is connected to the second end panel 136 at a top edge 141A, bottom edge 141B, and distal side edge 141C, and open at the proximal side edge 141D, to form a pocket. The pocket is sized to slidably receive a digital media disk 90. The proximal edge 141D of the pocket member 141 may include a semicircular cutout 144 that is positioned to expose the central aperture 92 of the digital media disk 90, to permit a user to remove the disk 90 by inserting a finger into the aperture 92, to slide the disk 90 outwardly, away from the pocket.

The hinge portion 118 between the first end panel 116 and the middle panel 126 is wider than the hinge portion 128 between the middle panel 126 and the second end portion 136, such that when the sleeve assembly 100 is folded or closed, as shown in FIG. 1, the hinge portion 118 will accommodate the thickness of the second end panel 136, including the digital media disk 90.

Figure 3:
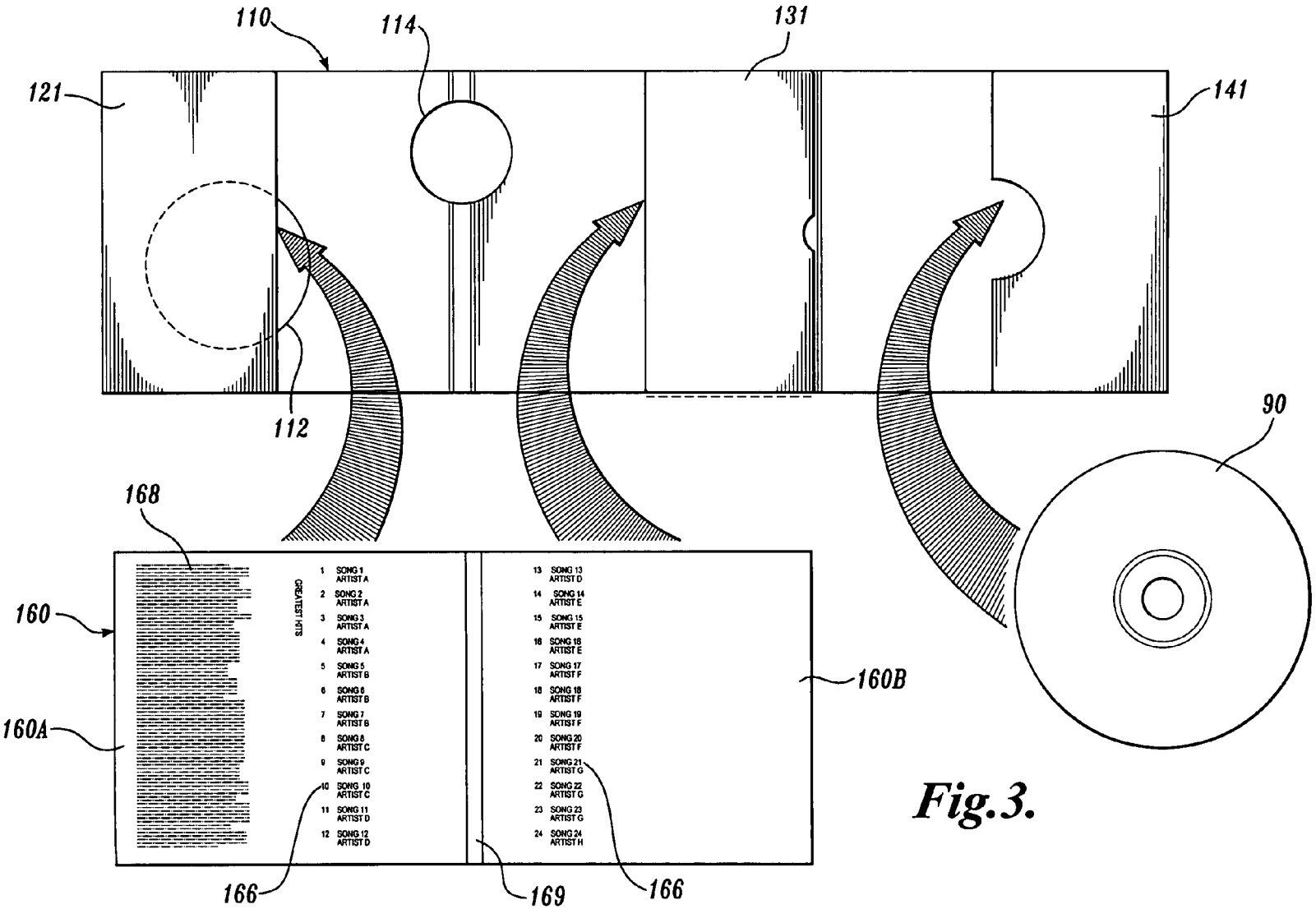
FIG. 3 is an exploded view of the sleeve assembly shown in FIG. 1, showing insertion of the placard and the digital media disk.

It will be appreciated from FIG. 3 that the placard 160 is sized to overlie the combined first end panel 116 and middle panel 126, such that the opposite end portions 160A, 160B of the placard 160 may be slidably inserted in the respective flat channels formed by the first and second retaining members 121, 131. In particular, the placard 160 is a flexible, simple paperboard panel, wherein the left end 160A may be inserted underneath the first retaining member 121 and the right end 160B may be inserted underneath the second retaining member 131. The placard 160 may then be slidably adjusted to generally overlie the first end panel 116 and the middle panel 118 of the sleeve member 110. The digital media disk 90 is inserted into the pocket formed by the pocket member 141. The placard 160 includes a center hinge portion 169 that overlies the sleeve member hinge portion 118.

Figure 4A:
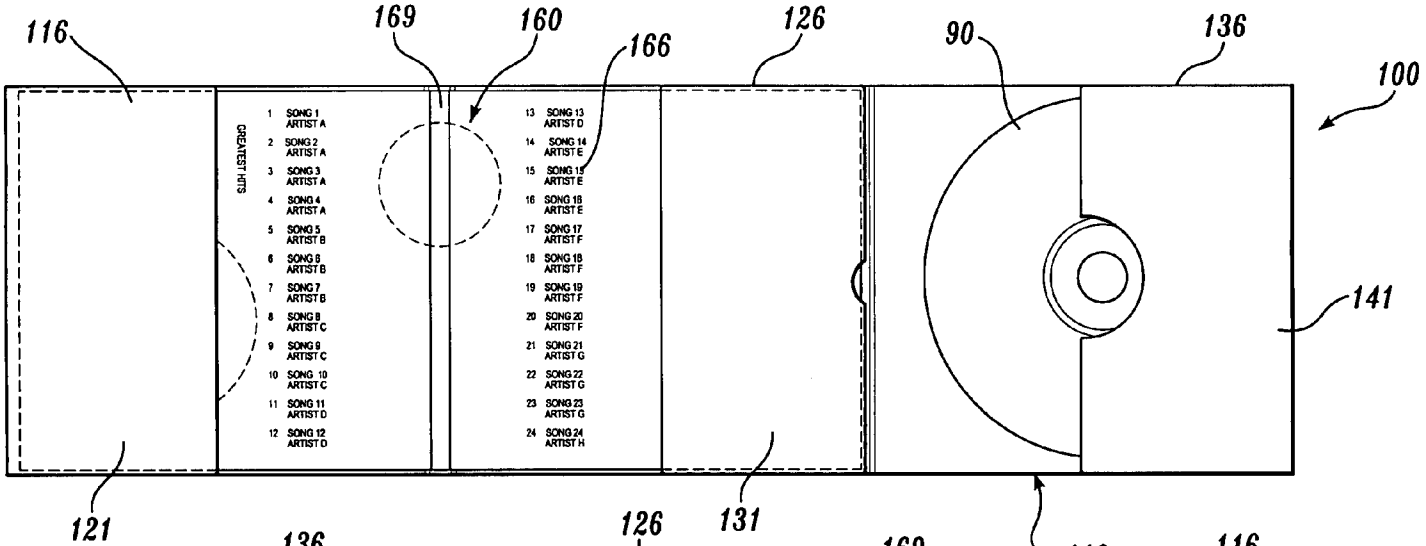
FIGS. 4A and 4B show front and back views of the sleeve assembly shown in FIG. 1, wherein the sleeve assembly is fully open.
Figure 4B:
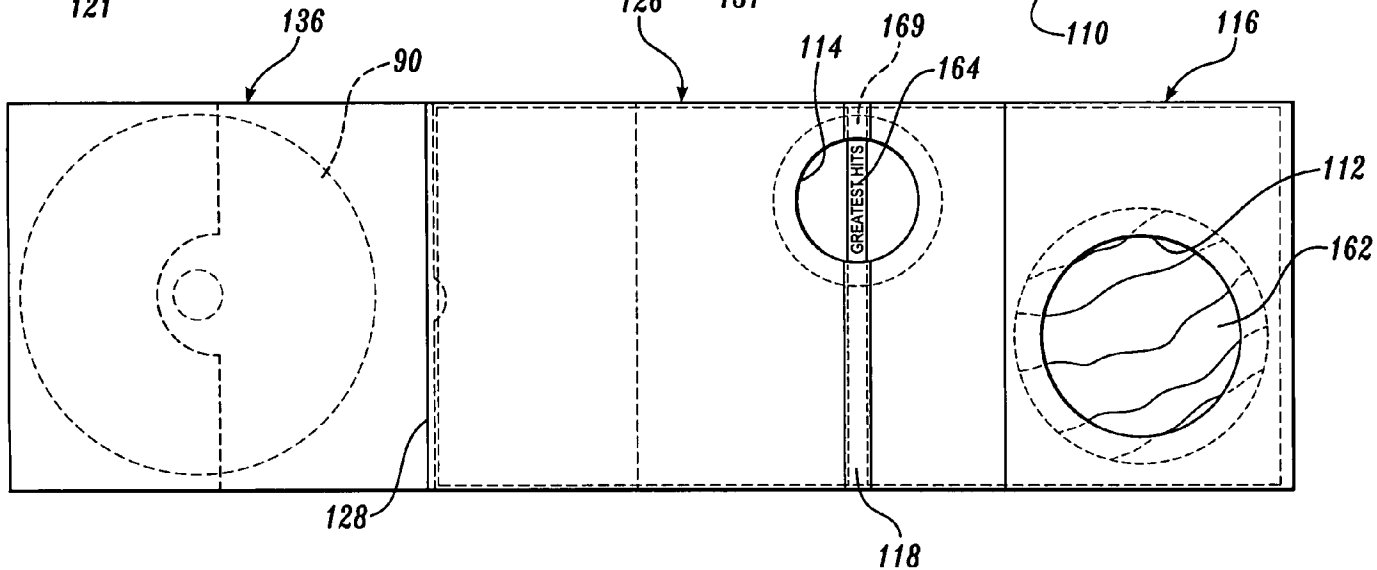

FIG. 4A shows a front view of the open, assembled sleeve assembly 100, and FIG. 4B shows a rear view of the sleeve assembly 100. It is contemplated that the front of the placard 160 may include a third identifying indicia 166 suitable for the particular digital media disk—for example, a playlist, user instructions, included features, copyright notice, or other product information. It is also contemplated that a fourth identifying indicia 168 may be printed one or both of the end portions 160A, 160B of the placard 160 that are obscured by the first and second retaining members 121, 131. For example, it may be aesthetically desirable to put rarely accessed information or semiprivate information on the end portions 160A, 160B of the placard 160.

Referring now to FIG. 4B, the back side of the placard 160 includes first and second identifying indicia 162, 164 that are positioned to be visible through the front aperture 112 and spine aperture 114, respectively, when the placard 160 is in the desired position. It will now be appreciated that in the preferred embodiment the sleeve member 110 does not include any printed information or other indicia that is particular to the specific digital media disk 90 and, therefore, the sleeve member may be generically used with different disks. For example, identical sleeve members 110 may be used with a whole collection of different music CDs, which may result in significant manufacturing and cost reductions. It is contemplated, however, that the sleeve member 110 might include generic information, such as by printing, embossing, or otherwise, such as a house trademark, manufacturer or distributor identification, commercial information, or aesthetic markings. The placard 160 contains identifying indicia that may be specific to the digital media disk 90 with which it is associated. The placard 160 is preferably a simple rectangular, flat piece of paperboard that is easily printed on. Moreover, the first and second identifying indicia 162, 164 may be printed on only the relatively small portion of the back side of the placard 160 that is visible through the apertures 112, 114 of the sleeve member 110.

Figure 5:
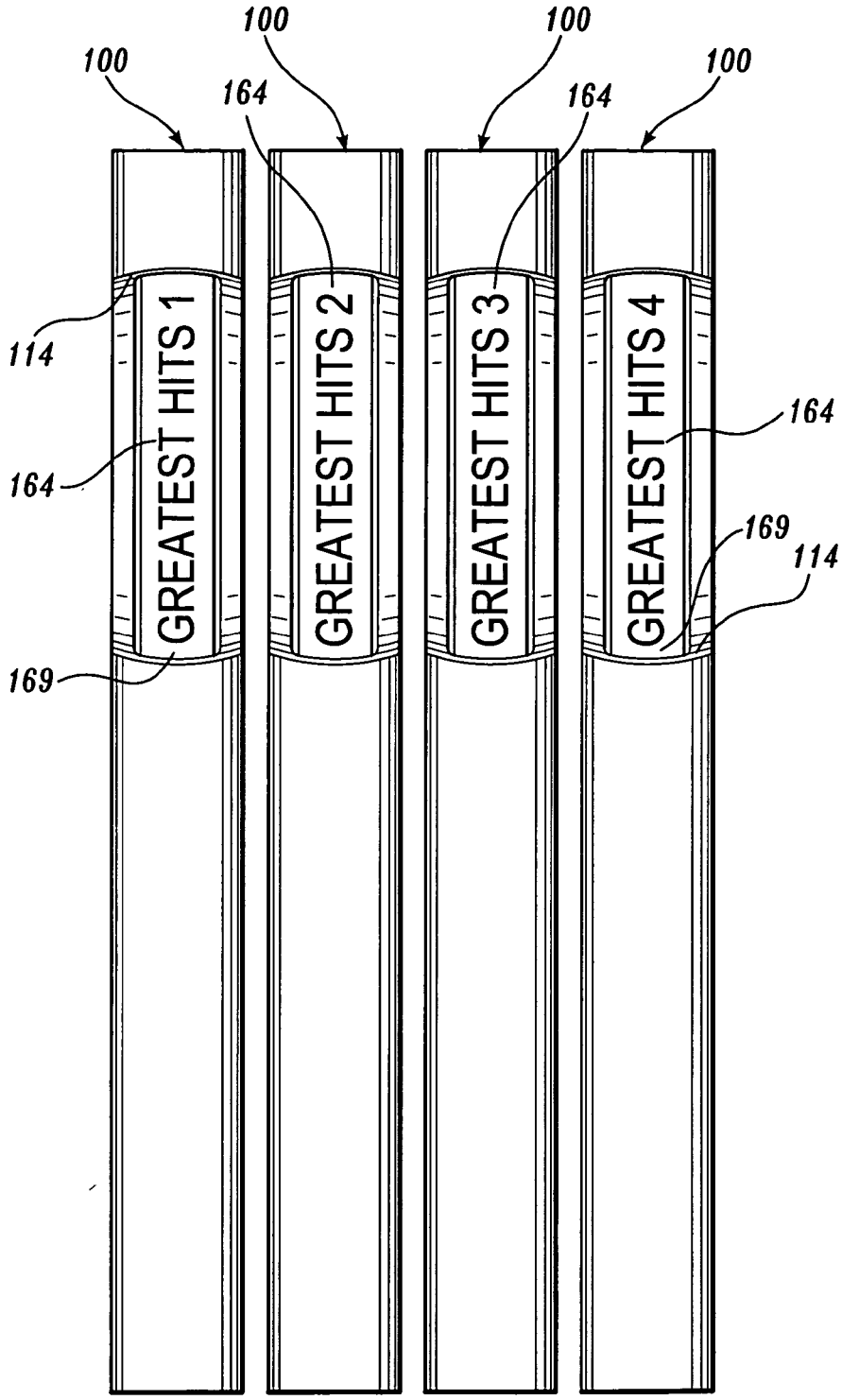
FIG. 5 is an end view showing a number of assembled sleeve assemblies.

In particular, it will be appreciated from FIG. 5 that the second identifying indicia 164, visible through the spine aperture 114, permits a user to identify and select a particular digital media disk (not shown) even when a plurality of sleeve assemblies 100 is stacked or otherwise having only the edge characterized by the hinge portion 118 visible.

Figure 6:
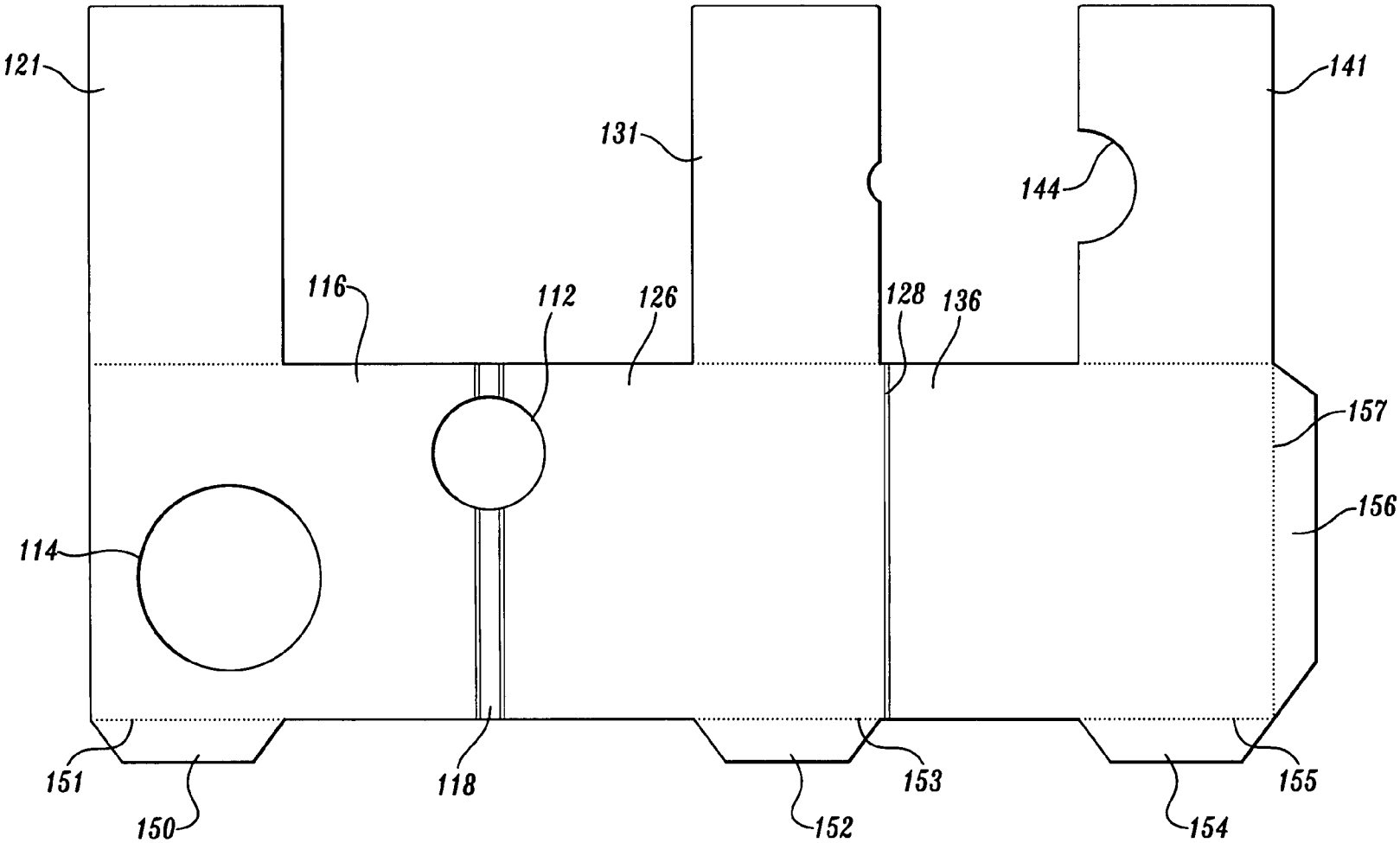
FIG. 6 is a plan view of the die cut blank, showing the fold lines for making the sleeve portion of the sleeve assembly shown in FIG. 1.

A die cut form 111 for the sleeve member 110 is shown in FIG. 6. The form 110 is a single, flat paperboard form, including the first end panel 116, middle panel 126, and second end panel 136, first and second retaining members 121,131, and pocket member 141. Front aperture 112, and spine aperture 114 are precut. It will be appreciated that although the front aperture 112 and the spine aperture 114 are shown as circular, other shapes are possible and contemplated by the present invention, including square, oval, and the like. It is also contemplated that there may be more than two apertures that permit additional or other portions of the placard 160 to be visible through the sleeve member 110, including, for example, a large number of relatively small apertures arranged in an aesthetically pleasing pattern.

Tab members 150, 152, 154, and 156 are positioned to be folded along corresponding fold lines 151, 153, 155, and 157, respectively. It will be apparent from FIG. 6 that to assemble the sleeve member, the tab members 150, 152, 154, and 156 are folded inwardly, and an adhesive is applied thereto. The retaining members 121, 131 and the pocket member 141 may then be folded downwardly to engage the appropriate tab members to form the sleeve member 110.

While the preferred embodiment of the invention has been illustrated and described, it will be appreciated that various changes can be made therein without departing from the spirit and scope of the invention.

What is claimed is:

1. A sleeve assembly for holding a digital media disk, the sleeve assembly comprising:

a multipanel sleeve member including:

(i) a first panel having an outer edge and an inner edge, the first panel having a pocket member defining a pocket that is closed on three sides and open toward the inner edge of the first panel;

(ii) a second panel having a first inner edge hingedly connected to the first panel inner edge and an oppositely disposed second inner edge, the second panel further having a first retaining member; and (iii) a third panel having an inner edge hingedly connected to the second inner edge of the second panel and an outer edge, the third panel further having a viewing aperture therethrough, and a second retaining member; and a placard removably retained by the first and second retaining members such that a portion of the placard is visible through the viewing aperture, the placard further having identifying indicia on the portion of the placard visible through the viewing aperture;

wherein the pocket is adapted to slidably receive a digital media disk.

2. The sleeve assembly of claim 1, further comprising a spine aperture that straddles the second panel and the third panel, and wherein the placard includes a second identifying indicia that is positioned to be visible through the spine aperture.

3. The sleeve assembly of claim 2, wherein the viewing aperture is circular.

4. The sleeve assembly of claim 2, wherein the sleeve member is made from a single die-cut paperboard blank.

5. The sleeve assembly of claim 4, wherein the hinged connection between the second panel and the third panel is formed by two closely spaced parallel folds.

6. The sleeve assembly of claim 4, wherein the first panel pocket member further comprises an edge cutout that is sized and positioned to expose a center aperture in the received digital media disk.

7. The sleeve assembly of claim 4, wherein the placard further comprises a third identifying indicia printed on a front side of the placard.

8. The sleeve assembly of claim 4, wherein the sleeve assembly is adapted to retain a compact disk having musical content, and wherein the third identifying indicia printed on the placard is a playlist identifying the musical content.

9. The sleeve assembly of claim 4, wherein the sleeve member is free of any markings particular to the received digital media disk.

10. The sleeve assembly of claim 4, wherein the placard is sized to substantially cover a top surface of the second and third panels of the sleeve member.

11. A sleeve assembly for holding a compact disk, the sleeve assembly comprising:

a tri-fold sleeve member having a middle panel hingedly attached to oppositely disposed first and second end panels, wherein the first end panel and the middle panel each includes retaining members, and the second end panel includes a pocket member defining a pocket, at least one of the first end panel and the middle panel having a viewing aperture therethrough; and a placard having a plurality of identifying indicia printed thereon, the placard being removably retained by the retaining members such that the placard overlies the first end panel and the middle panel, and wherein at least a portion of the plurality of identifying indicia printed on the placard is visible through the viewing aperture;

wherein the pocket is adapted to slidably receive a compact disk.

12. The sleeve assembly of claim 11 further comprising a spine aperture that straddles the first end panel and the middle panel, and wherein at least a portion of the identifying indicia printed on the placard is positioned to be visible through the spine aperture.

13. The sleeve assembly of claim 12, wherein the viewing aperture is circular.

14. The sleeve assembly of claim 12, wherein the sleeve member is made from a single die-cut paperboard blank.

15. The sleeve assembly of claim 14, wherein the hinged connection between the first end panel and the middle panel is formed by two closely spaced parallel folds.

16. The sleeve assembly of claim 14, wherein the second end panel pocket member further comprises an edge cutout that is sized and positioned to expose a center aperture in the received compact disk.

17. The sleeve assembly of claim 14, wherein the placard further comprises additional identifying indicia printed on a front side of the placard.

18. The sleeve assembly of claim 14, wherein the compact disk has musical content, and wherein the additional identifying indicia printed on the placard is a playlist identifying the musical content.

19. The sleeve assembly of claim 14, wherein the sleeve member is free of any markings particular to the received compact disk.

20. The sleeve assembly of claim 14, wherein the placard is sized to substantially cover a top surface of the first end panel and the middle panel of the sleeve member.

* * * * *